US005889877A

United States Patent [19]

Bunzow

[11] Patent Number: 5,889,877

[45] Date of Patent: Mar. 30, 1999

[54] CABINET FOR A LOUDSPEAKER

[76] Inventor: Hans-Dieter Bunzow, Reppestr, 30, Erlangen, 91054, Germany

[21] Appl. No.: 46,144

[22] Filed: Mar. 23, 1998

[30] Foreign Application Priority Data

Mar. 25, 1997 [DE] Germany ..... 297 05 406 U

[51] Int. Cl.[6] ..... H04R 25/00

[52] U.S. Cl. ..... 381/386; 381/336; 181/191

[58] Field of Search ..... 381/304, 305, 381/87, 89, 332, 336, 345, 386, 387, 146, 151, 165; 181/148, 153, 198

[56] References Cited

U.S. PATENT DOCUMENTS 4,083,426 4/1978 Peugh ..... 181/199

4,231,446 11/1980 Weiss ..... 181/199

*Primary Examiner*—Huyen Le

*Attorney, Agent, or Firm*—Thomas Vigil

[57] ABSTRACT

A cabinet for a loudspeaker with a preferably circular cross-section, in which the loudspeaker is closed on the front side substantially flush with one side of the cabinet and wherein means are provided for positioning the cabinet, wherein, starting from the periphery of the loudspeaker, the cabinet expands all round obliquely towards the rear for a specific distance, and in which the oblique surface consists of a plurality of oblique partial surfaces arranged at differing shallow angles side by side and/or one behind the other, and the cabinet tapers rearwardly of the specific distance towards the rear so as to be closed.

12 Claims, 5 Drawing Sheets

CABINET FOR A LOUDSPEAKER

BACKGROUND OH THE INVENTION

1. Field of the Invention

The present invention relates to a cabinet for a loudspeaker.

2. Description of the Prior Art

Arranging loudspeakers in box-shaped cabinets, so-called enclosures, is known. Disturbances due to diffraction and interference occur on cabinets of this kind. The sound source of the loudspeaker which is ideally a point sound source produces a primary sound wave which sets up several time-delayed secondary sound waves at the edges of the loudspeaker cabinet The primary wave is superimposed with the secondary waves and produces pronounced interference phenomena within hearing range. Because of this undesired effect, enhancements and attenuations in the transfer characteristic result at certain frequencies. Moreover, the pulse response deteriorates as a result of the secondary waves arriving time-delayed. The attempt has been made to counter this effect by chamfering or rounding the edges However, it has been concluded that, even with a spherical cabinet as shown, for example; in DE-A-37 20 374, with conventional dimensions marked diffraction effects occur at the critical transition between the flange of a circular loudspeaker chassis and the spherical shape.

SUMMARY OF THE INVENTION

The object of the present invention is to provide a loudspeaker cabinet whose exterior contour lends itself to markedly reducing disturbances due to diffraction and interference and which has a visually attractive appearance.

According to the invention, starting from the periphery of the loudspeaker, the cabinet expands all round obliquely towards the rear for a specific distance and the oblique surface consists of a plurality of oblique partial surfaces arranged at differing shallow angles side by side and/or one behind the other, the cabinet tapering rearwardly of the specific distance towards the rear so as to be closed. According to a preferred embodiment of the invention, the oblique partial surfaces are evenly arranged and the tapered part of the cabinet similarly consists of evenly arranged oblique partial surfaces. The arrangement of the partial surfaces is preferably selected such that the cabinet resembles a cut gemstone, for instance a brilliant full cut.

Behind the loudspeaker the cabinet may have a cavity which, in the case of a spherical assembly, is cylindrical for the magnet, but which is preferably shaped so as to taper towards the tapered end of the cabinet. The cavity is preferably formed by evenly arranged oblique partial surfaces, but alternatively it may be conical. Parallel walls are avoided.

According to an embodiment of the invention, the loudspeaker is a loudspeaker with a spherical diaphragm and a circular mounting flange. Conical loudspeakers and other loudspeakers with a frame may also be used. Size variations may be compensated for by means of shims. The cabinet has a depression for the mounting flange or the loudspeaker frame.

According to an embodiment of the invention the cabinet is provided with a tubular stand and a base and the connection lead for the loudspeaker is run through the tubular stand.

The cabinet is preferably made of a preferably transparent plastics material, such as acrylic glass. However, non-transparent plastics materials and other materials such as metal, ceramics, wood, composite materials etc. may also be used.

DESCRIPTION OF THE PREFERRED EMBODIMENT

Figure 1:
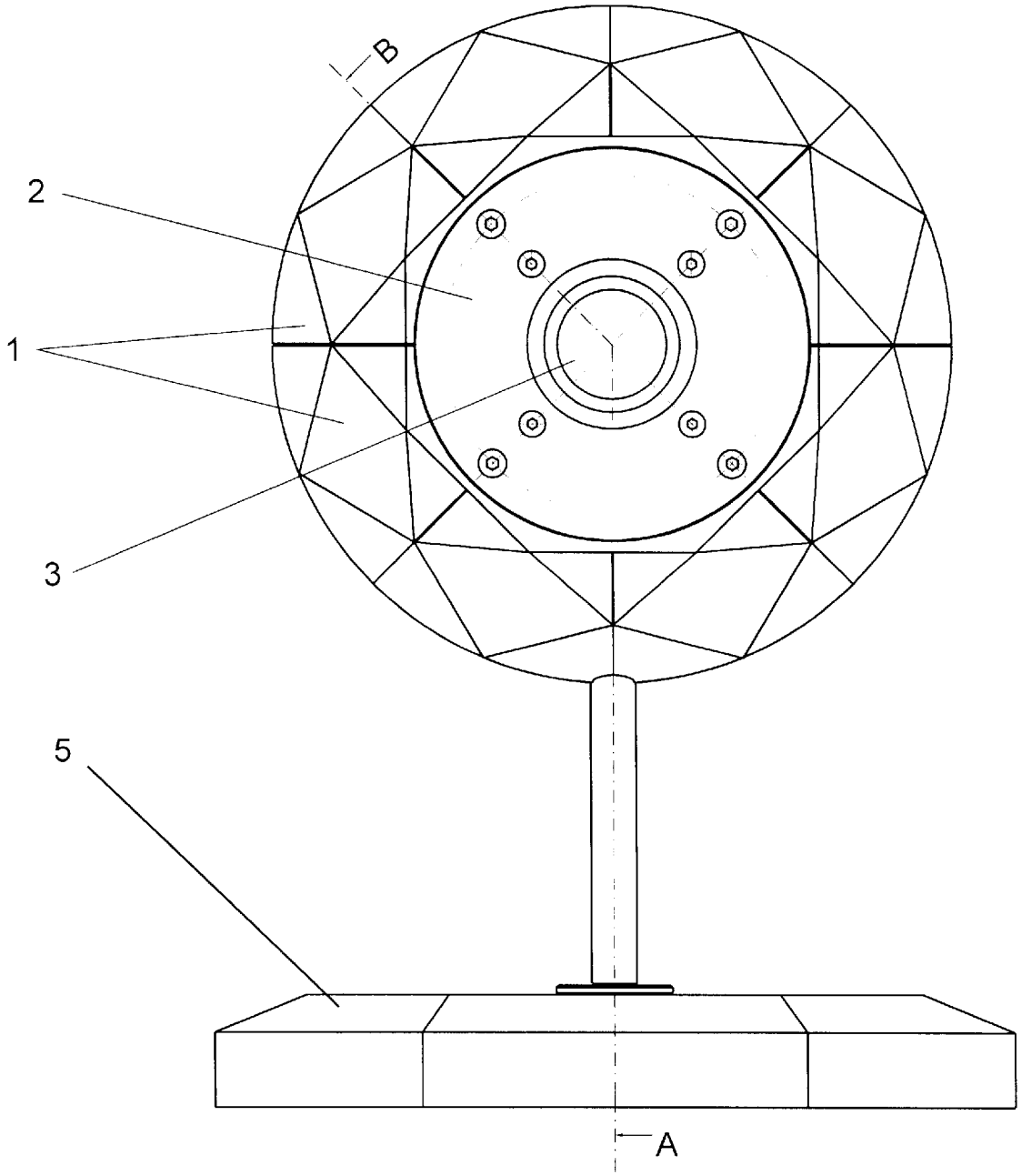
FIG. 1 shows a front view of a loudspeaker with a cabinet.
Figure 2:
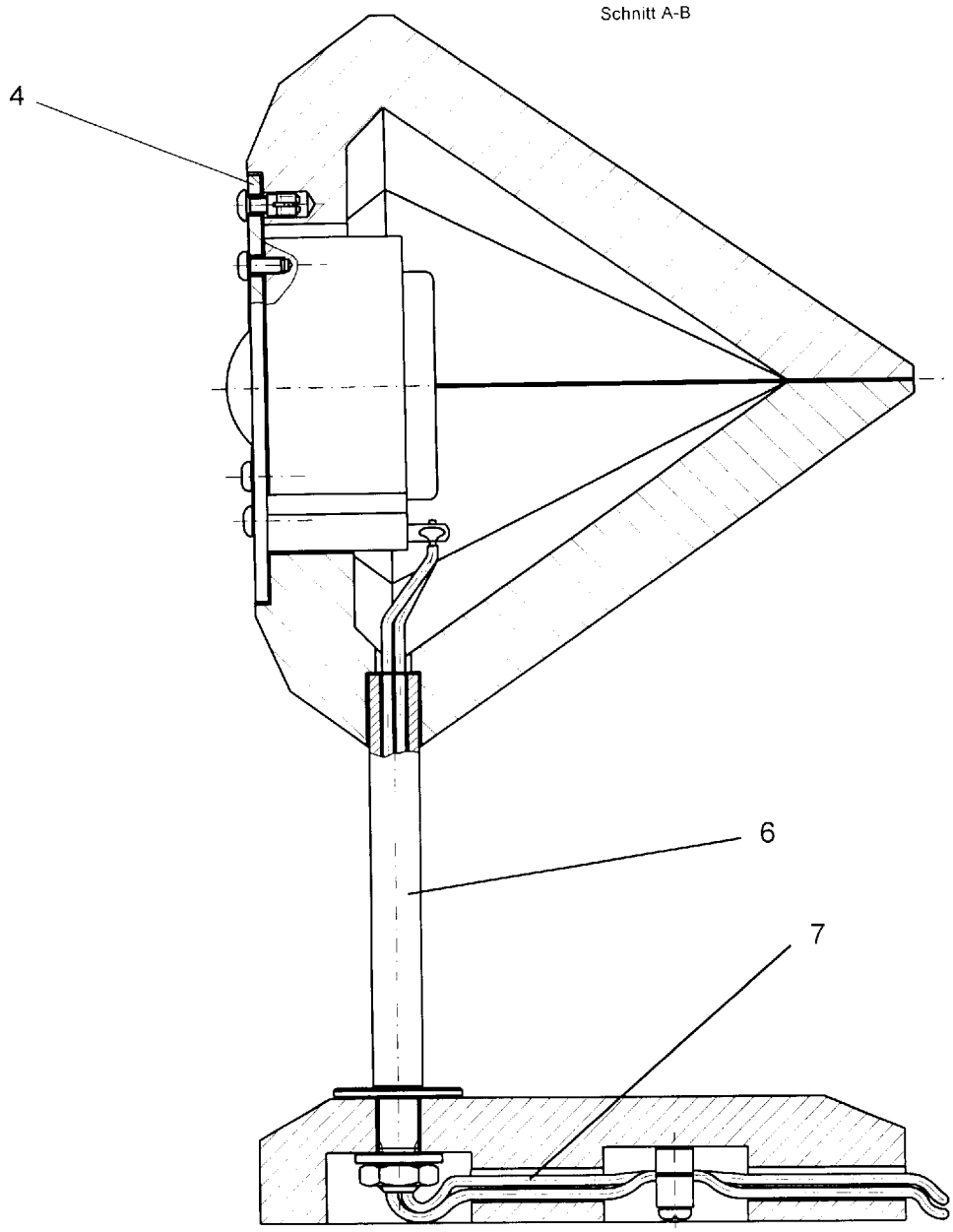
FIG. 2 shows a section along line B–A of FIG. 1.

The cabinet of FIG. 1 and 2 is a hollow body which, with the exception of the opening for the loudspeakers is composed internally and externally of oblique partial surfaces, the numerous even facets 1, which first expand all round obliquely towards the rear from the loudspeaker 3 or the mounting flange 4 thereof, and then at a specific distance from the loudspeaker periphery taper obliquely towards the rear. The hollow body is mounted on a tubular stand 6 which is held in a base 5. The connection lead 7 is run through the tubular stand and the base.

Figure 3:
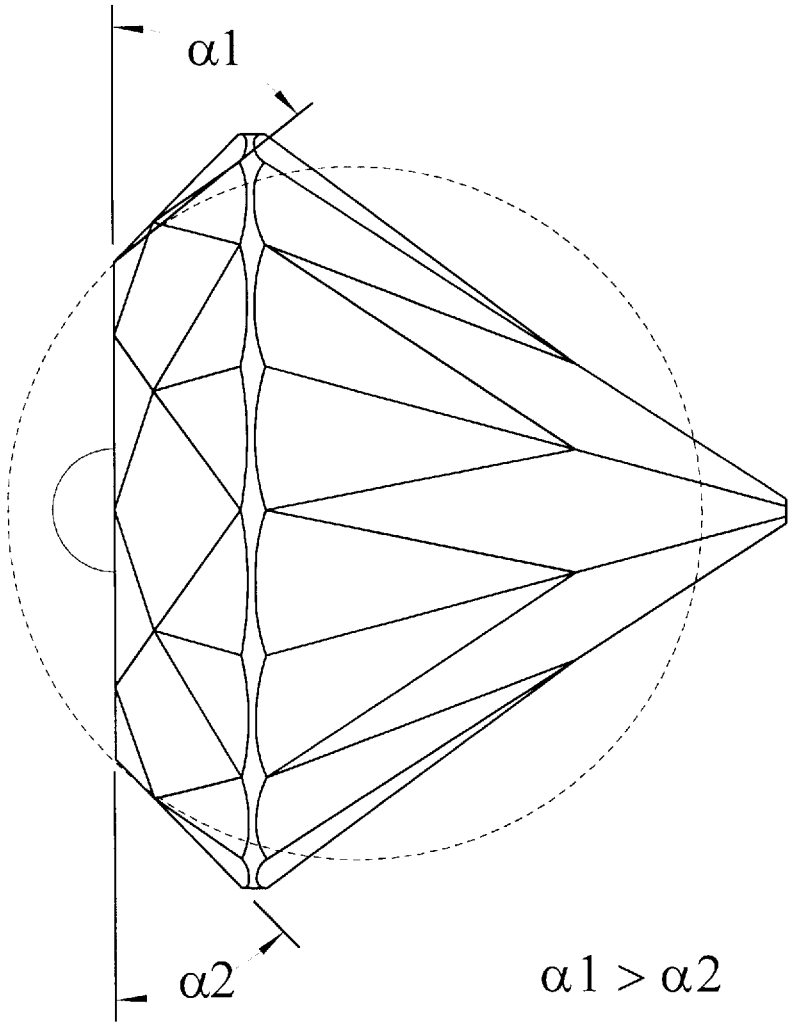
FIG. 3 shows a schematic representation comparing a cabinet according to the invention with a spherical cabinet.
Figure 4:
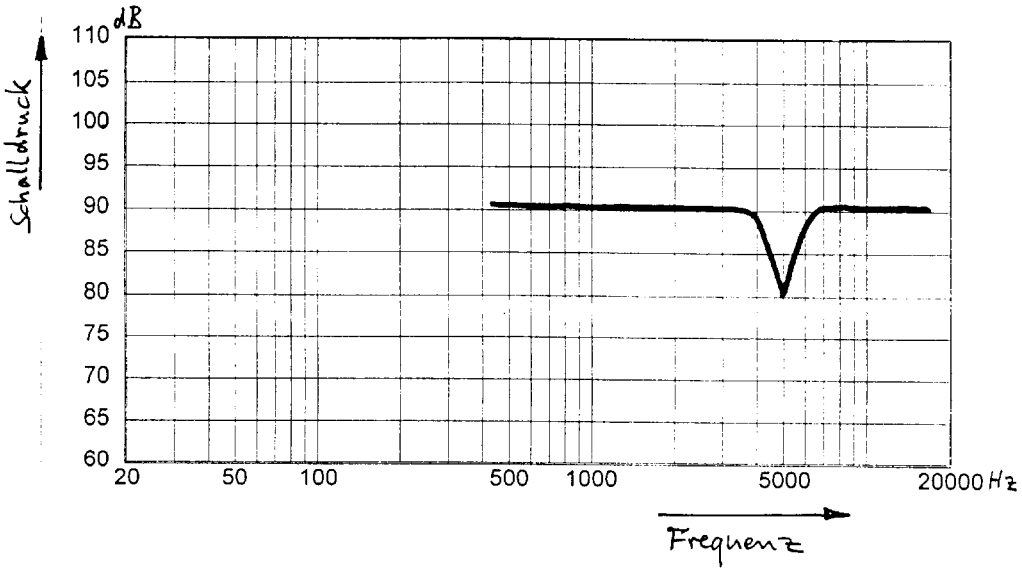
FIGS. 4 and 5 show schematic charts of the sound pressure response in the case of the spherical cabinet and the cabinet according to the invention
Figure 5:
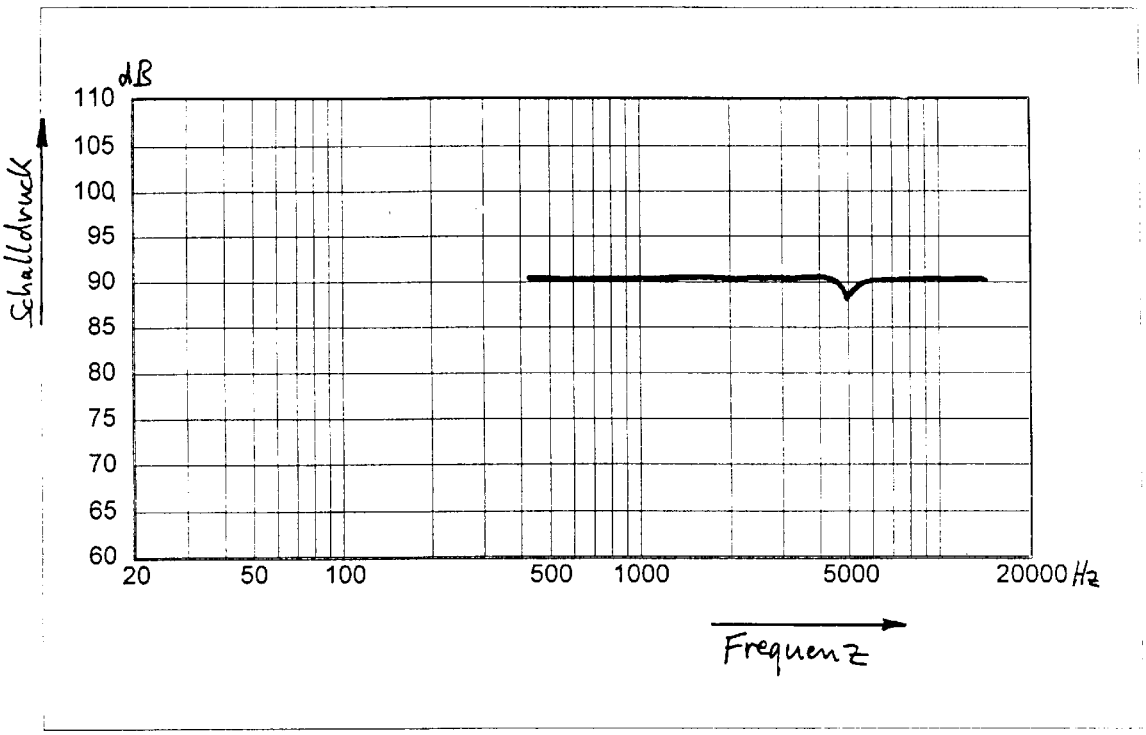

FIG. 3 compares a cabinet according to the invention with a spherical cabinet of approximately the same size. The alpha angles in the cabinet according to the invention are more favourable for reducing the edge diffraction at the transition from the chassis to the cabinet The faceting also moderates the sound diffraction: the result is attenuated diffraction effects which are distributed over different frequencies The basic sound pressure response represented schematically in FIGS. 4 and 5 shows strong edge diffraction in the case of a loudspeaker chassis in a spherical cabinet (FIG. 4) and markedly reduced edge diffraction in the case of the cabinet according to the invention.

I claim:

1. A cabinet for a loudspeaker with a circular cross-section, in which the loudspeaker is closed on the front side substantially flush with one side of the cabinet and wherein means are provided for positioning the cabinet, characterised in that, starting from the periphery of the loudspeaker, the cabinet expands all round obliquely towards the rear for a specific distance, in that the oblique surface consists of a plurality of oblique partial surfaces (1) arranged at differing shallow angles side by side and/or one behind the other, and in that the cabinet tapers rearwardly of the specific distance towards the rear so as to be closed.

2. A cabinet according to claim 1, characterised in that the oblique partial surfaces (1) are evenly arranged.

3. A cabinet according to claim 1, characterised in that the tapered part of the cabinet similarly consists of evenly arranged oblique partial surfaces.

4. A cabinet according to claim 1, characterised in that it has a cavity behind the loudspeaker (3).

5. A cabinet according to claim 4, characterised in that the cavity tapers towards the tapered end of the cabinet.

6. A cabinet according to claim 5, characterised in that the cavity is formed by evenly arranged oblique partial surfaces.

7. A cabinet according to claim 5, characterised in that the cavity is conical.

8. A cabinet according to claim 1, characterised in that the loudspeaker is a loudspeaker (3) with a spherical diaphragm and a circular mounting flange (4).

9. A cabinet according to claim 8, characterised in that the cabinet has a depression for the mounting flange, or the loudspeaker frame.

10. A cabinet according to claim 1, characterised in that it is provided with a tubular stand (6) and a base (5) and in that the connection lead for the loudspeaker is run through the tubular stand.

11. A cabinet according to claim 10, characterised in that the plastics material is an acrylic glass.

12. A cabinet according to claim 1, characterised in that it consists of a transparent plastics material.

* * * * *

UNITED STATES PATENT AND TRADEMARK OFFICE

CERTIFICATE OF CORRECTION

PATENT NO. : 5,889,877

DATED : March 30, 1999

INVENTOR(S) : Hans-Dieter Bunzow

It is certified that error appears in the above-indentified patent and that said Letters Patent is hereby corrected as shown below:

On the title page: Please change the street address of the inventor from "Reppestr. 30" to --Rennestr. 30--

Column 4, line 1, change "11" to --12--; change "10" to --11--; change "12" to --11--

Column 4, line 3, change "12" to --11--

Column 1, line 14, after "cabinet" insert --.--

Column 2, line 17, change "loudspeakers" to --loudspeaker--

Signed and Sealed this

Thirtieth Day of May, 2000

*Attest:*

Q. TODD DICKINSON

*Attesting Officer*

*Director of Patents and Trademarks*